US005506589A

United States Patent [19]

Quan et al.

[11] Patent Number: 5,506,589

[45] Date of Patent: Apr. 9, 1996

[54] MONOPULSE ARRAY SYSTEM WITH AIR-STRIPLINE MULTI-PORT NETWORK

[75] Inventors: Clifton Quan, Arcadia; Donald E. Bostrom, Sherman Oaks; Mark Y. Hashimoto, Gardena, all of Calif.; Ruth Dean, deceased, late of New Cumberland, Pa., by Martin Dean, executor; Rosie M. Jorgenson, Norwalk, Calif.

[73] Assignee: Hughes Aircraft Company, Los Angeles, Calif.

[21] Appl. No.: 52,202

[22] Filed: Apr. 19, 1993

[51] Int. Cl.[6] ..... H01Q 3/26

[52] U.S. Cl. ..... 342/373; 342/80; 342/427; 342/154

[58] Field of Search ..... 342/373, 372, 342/80, 154, 427

[56] References Cited

U.S. PATENT DOCUMENTS

| | | | |
|---|---|---|---|
| 4,734,700 | 3/1988 | Brunner | 342/373 |
| 4,827,270 | 5/1989 | Udagawa et al. | 343/853 |
| 4,849,763 | 7/1989 | Dufort | 342/372 |
| 4,952,895 | 8/1990 | Quan | 333/121 |
| 4,957,456 | 9/1990 | Olson et al. | 439/578 |
| 5,162,804 | 11/1992 | Uyeda | 342/373 |

OTHER PUBLICATIONS

"Introduction to Radar Systems," *M. Skolnik,* 1980, at pp. 160–167.

"Monopulse Networks for Series Feeding an Array Antenna," A. R. Lopez, IEEE Trans. on Antenna and Propagation, vol. AP–16, No. 4, Jul. 1968, p. 436.

"Compact Highly Integrated Dual Linear Antenna Feed," J. Smolko, Proc. of the 1990 Antenna Applications Sym., Sep. 1990, p. 538.

"Practical Phased Array Antenna Systems," *Eli Brookner, Artech House,* 1991, at pp. 6—6 to 6–9.

*Primary Examiner*—Thomas H. Tarcza
*Assistant Examiner*—Dao L. Phan
*Attorney, Agent, or Firm*—Leonard A. Alkov; W. K. Denson–Low

[57] ABSTRACT

An array system with radiating elements and a wideband monopulse power divider network with dual channel input ports and multiple output ports. Each input channel of the network excites a uniquely different RF amplitude and phase distribution out of each of the corresponding "n" output ports. All ports are matched and isolated from each other across a wide instantaneous frequency. Also the RF power distribution will track in amplitude and phase across a wide frequency band. This is achieved through a special arrangement of air-stripline matched power dividers, attenuator, phase shifters, and Magic-Tee couplers. The output ports of the network can be connected directly to the radiating elements or to partitioned feed circuits which are in turn connected to sub-sets of the radiating elements.

17 Claims, 10 Drawing Sheets

224
220
100
205N
222
230
228
52
226
205A
227
130N
262
260
132N
120N
130A
121B
121C
121E
132A
121D
121A
120A
260N
244
245
260A
248
54
240
210N
210A
50
110
250
246

FIG. 9A
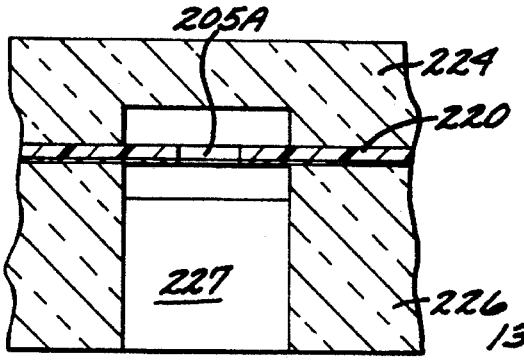
FIG. 9C
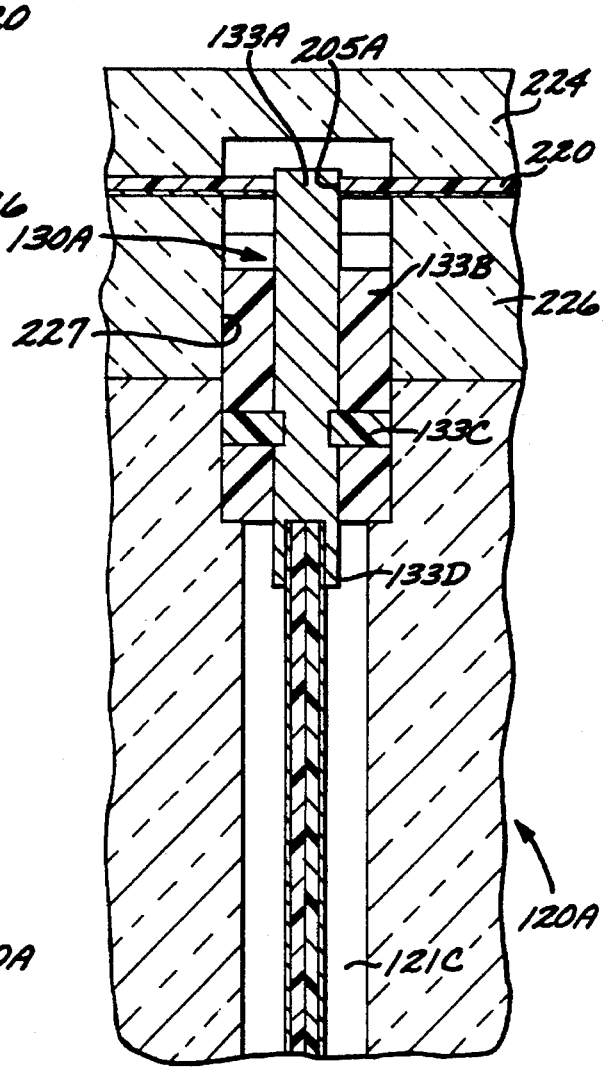
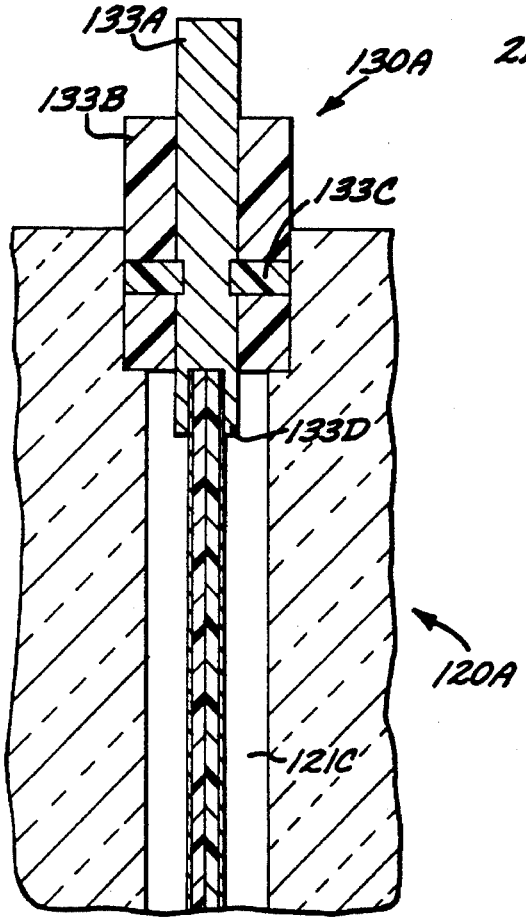
FIG. 9B

FIG. 10A
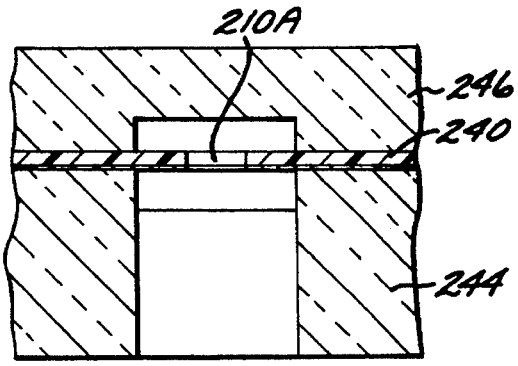
FIG. 10C
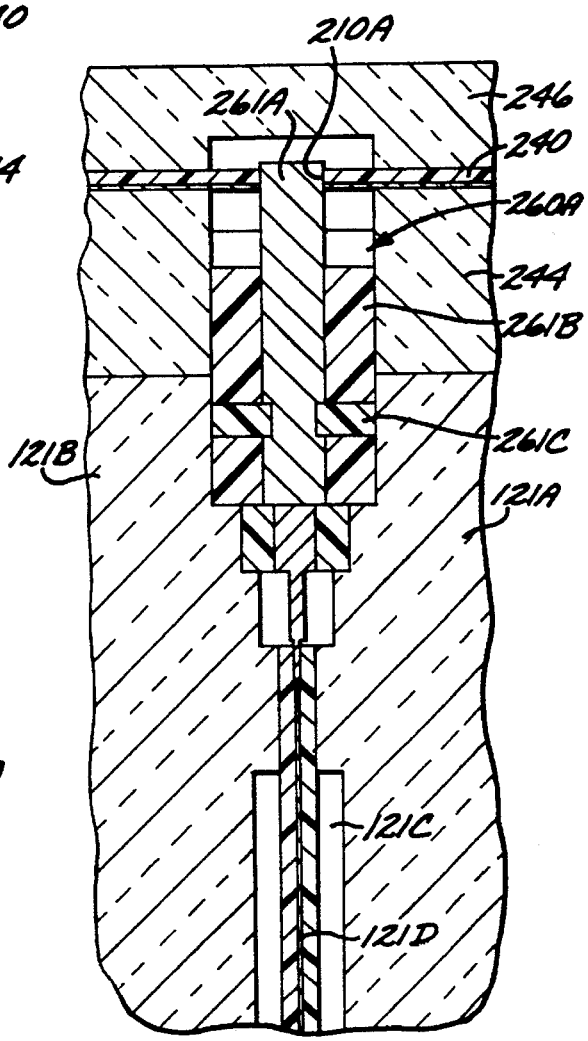
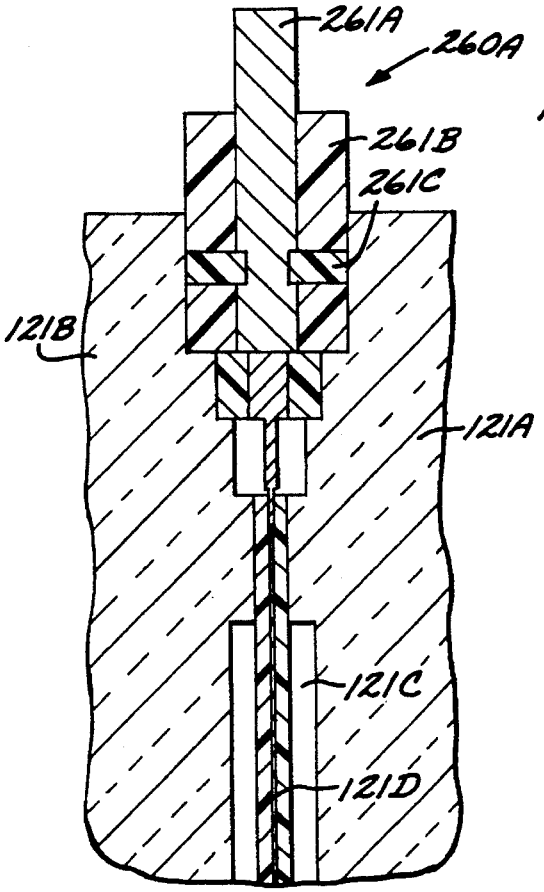
FIG. 10B

MONOPULSE ARRAY SYSTEM WITH AIR-STRIPLINE MULTI-PORT NETWORK

BACKGROUND OF THE INVENTION

The invention relates to microwave power divider circuity, and more particularly to monopulse power divider networks suitable for use in radar antenna arrays.

For an antenna array, the RF energy needed to excite the individual radiating elements originates from a single transmitter. The energy is then distributed to all the elements through the antenna feed network. To have the antenna operate across a wide instantaneous bandwidth, the feed network often uses a corporate architecture with matched four port power dividers (one port is terminated in a matched load) performing the RF power distribution.

To perform monopulse operation, the feeding of the array is typically split in halves (or quadrants), and then the halves (or quadrants) are combined together with a network of Magic-Tee couplers, as shown in FIG. 1. This network will provide an amplitude distribution across the array. However, the Magic-Tee couplers will create a 180 degree phase change between the two halves of the array at the difference port while maintaining equal phase for the sum port excitation. The results are two entirely different radiation patterns generated by the array. These two patterns are then used by the radar for monopulse tracking. The problem with this approach is that the optimal amplitude distribution required to generate a sum pattern with low sidelobes is very different from that required for low difference pattern sidelobes. Conventional monopulse and corporate feed networks can yield only one amplitude distribution.

One approach to realize separate sum and difference distributions is to have corresponding elements across the halves of the array connected together with Magic-Tee couplers fed by a separate sum feed network and difference feed network. Unfortunately this approach requires a formidable amount of excess transmission lines to connect all the components and thus resulting in depth and weight penalties.

Conventional monopulse networks are limited to two and four output ports. Their sum and difference channels excite only RF identical amplitude distributions with the only difference being phase reversal between ports. See, M. Skolnik, Introduction to Radar Systems, 1980, at pages 160–167. Ladder feeds have wide tunable frequency bandwidth and narrow instantaneous bandwidth, and require a number of different precision couplers. These couplers would either be machined slots in waveguide (expensive, bulky and bandwidth limited) or proximity couplers in stripline (requiring tight dimensional tolerances in the manufacturing process to make producible). Ladder feeds require a complicated conglomeration of additional couplers and Magic-Tee couplers to realize monopulse functions. The antenna beam will scan as a function of frequency with this feed. See A. Lopez, "Monopulse Networks for Series Feeding an Array Antenna," IEEE Tran. on Antenna and Propagation, Vol. AP-16, No. 4, July 1968, p. 436; J. Smolko, "Compact Highly Integrated Dual Linear Antenna Feed," Proc. of the 1990 Antenna Applications Sym., September 1990, p. 538.

Partitioned feeds using a waveguide conglomeration of magic-tees as used have narrow frequency bands and use excessive amounts of waveguide to interconnect all the individual components. "Practical Phased Array Antenna Systems," Eli Brookner, Artech House, 1991, at pages 6-6 to 6-9.

SUMMARY OF THE INVENTION

A monopulse radar antenna system is described, comprising a plurality of radiating elements coupled to a multi-port monopulse feed network. The monopulse feed network includes a sum feed network assembly having a sum input/output (I/O) port connected to a plurality of sum output ports by a sum feed circuit. The network further includes a difference feed network having a difference I/O port connected to a plurality of difference output ports by a difference feed circuit. In the preferred embodiment, the sum and difference feed circuits are implemented with air-stripline transmission lines, to provide low loss operation.

The monopulse network further a plurality of 180 degree coupler devices which are coupled to the sum and difference feed networks and to the radiating elements. Each coupler device has a coupler sum port and a coupler difference port, and first and second sidearm ports. Interconnection means are provided to connect the sum network output ports to corresponding coupler sum ports, and to connect the difference network output ports to corresponding coupler difference ports. The coupler sidearm ports are in turn coupled to the array radiating elements.

Preferably, the coupler devices are Magic-Tee couplers, also fabricated with air-stripline transmission lines. The sum and difference feed circuits include power dividers which provide independent sum and difference amplitude distributions across the sum and difference output ports. The interconnection means preferably includes orthogonal coaxial feedthrough interconnects which connect between the sum circuit output ports and the couplers, and between the difference circuit output ports and the couplers.

The coupler sidearm ports can be connected directly to the radiating elements in a given application, or to partitioned feed networks which are in turn connected to particular sets of the radiating elements.

BRIEF DESCRIPTION OF THE DRAWING

These and other features and advantages of the present invention will become more apparent from the following detailed description of an exemplary embodiment thereof, as illustrated in the accompanying drawings, in which:

FIGS. 9A–9C illustrate sum feed interconnections to the stripline circuits of the network of FIG. 7.

FIGS. 10A–10C illustrate difference feed interconnections to the stripline circuits in the network of FIG. 7.

DETAILED DESCRIPTION OF THE PREFERRED EMBODIMENT

Figure 1:
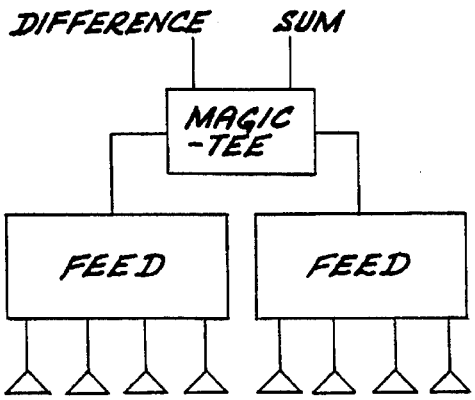
FIG. 1 PRIOR ART
FIG. 1 is a schematic diagram of an array antenna with a conventional monopulse network and feed.
Figure 2:
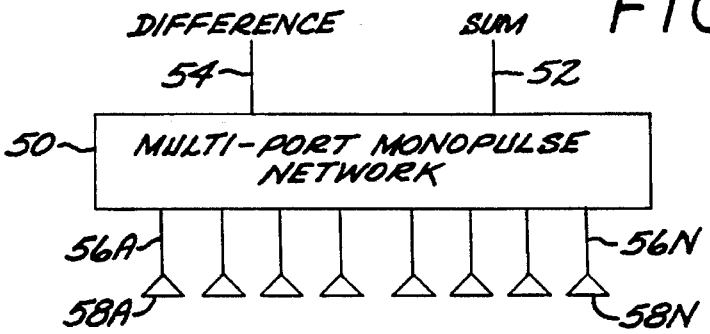
FIG. 2 is a schematic diagram of a monopulse array system with a multiport monopulse network, in accordance with this invention.

The multi-port monopulse network 50 shown in FIG. 2 solves the foregoing problems of the conventional monopulse feed networks. The network 50 includes sum and difference input/output (I/O) ports 52 and 54, and a plurality of output ports 56A–56N. A network in accordance with this invention generates separate amplitude and phase distributions for the sum and difference ports 52 and 54. Depending on performance and packaging requirements, this network can be configured to connect all the radiating elements 58A–58N as shown in FIG. 2, or to various clusters of elements or subarrays with partition feeds, as shown in FIGS. 3A–3D.

Figure 3A:
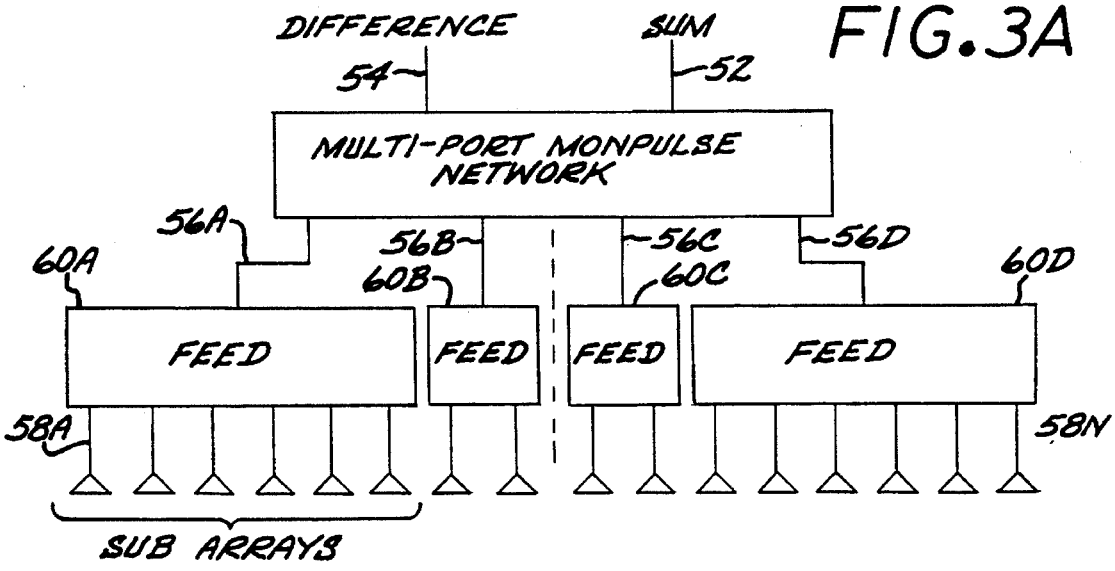
FIGS. 3A–3D illustrate schematic diagrams of alternate embodiments of an array antenna embodying a multiport monopulse network in accordance with the invention, configured with various partition feeds and subarrays.

FIG. 3A illustrates the output ports 56A–56D connected to a plurality of partitioned feed networks 60A–60D, which in turn are connected to clusters of the radiating elements 58A–58N.

Figure 3B:
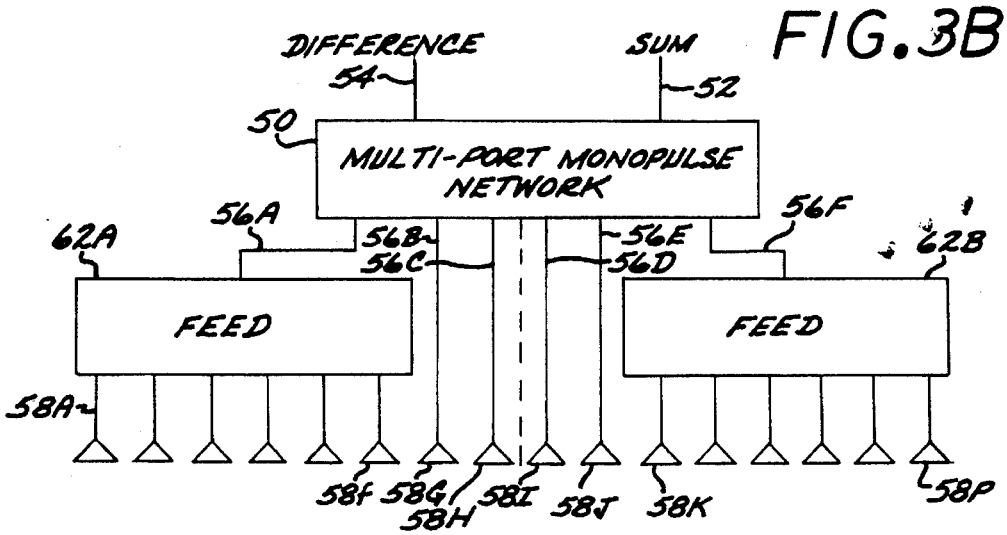

FIG. 3B illustrates output ports 56A and 56F connected to respective partitioned feed networks 62A and 62B, which in turn are connected to radiating elements 58A–58F and 58K–58P, with ports 56B–56E connected directly to radiating elements 58G–58J.

Figure 3C:
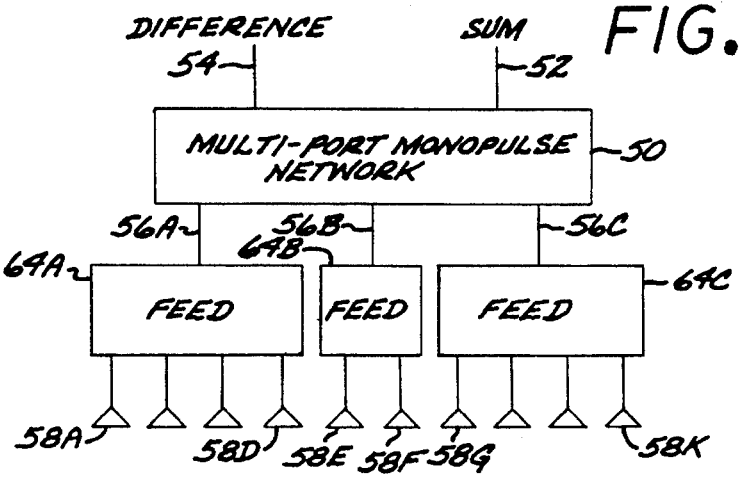

In the arrangement of FIG. 3C, port 56A is connected to partitioned feed 64A, which in turn is connected to radiating elements 58A–58D. Port 56B is connected to center partitioned feed 64B, which is in turn connected to center radiating elements 58E and 58F. Port 56C is connected to partitioned feed 64C, which is connected to radiating elements 58G–58K.

Figure 3D:
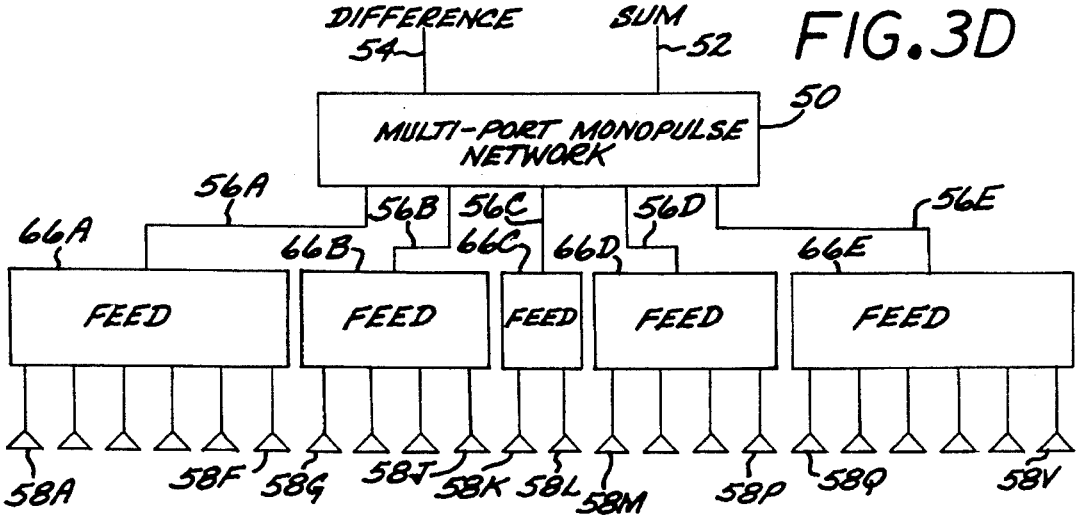

In FIG. 3D, output port 56A of network 50 is connected to partitioned feed 66A, which in turn is connected to radiating elements 58A–58F. Port 56B is connected to feed 66B, in turn connected to elements 58G–58J. Port 56C is connected to center feed 66C, in turn connected to center elements 58K and 58L. Port 56D is connected to feed 66D, in turn connected to elements 58M–58P. Port 56E is connected to feed 66E, in turn connected to elements 58Q–58V.

Figure 4:
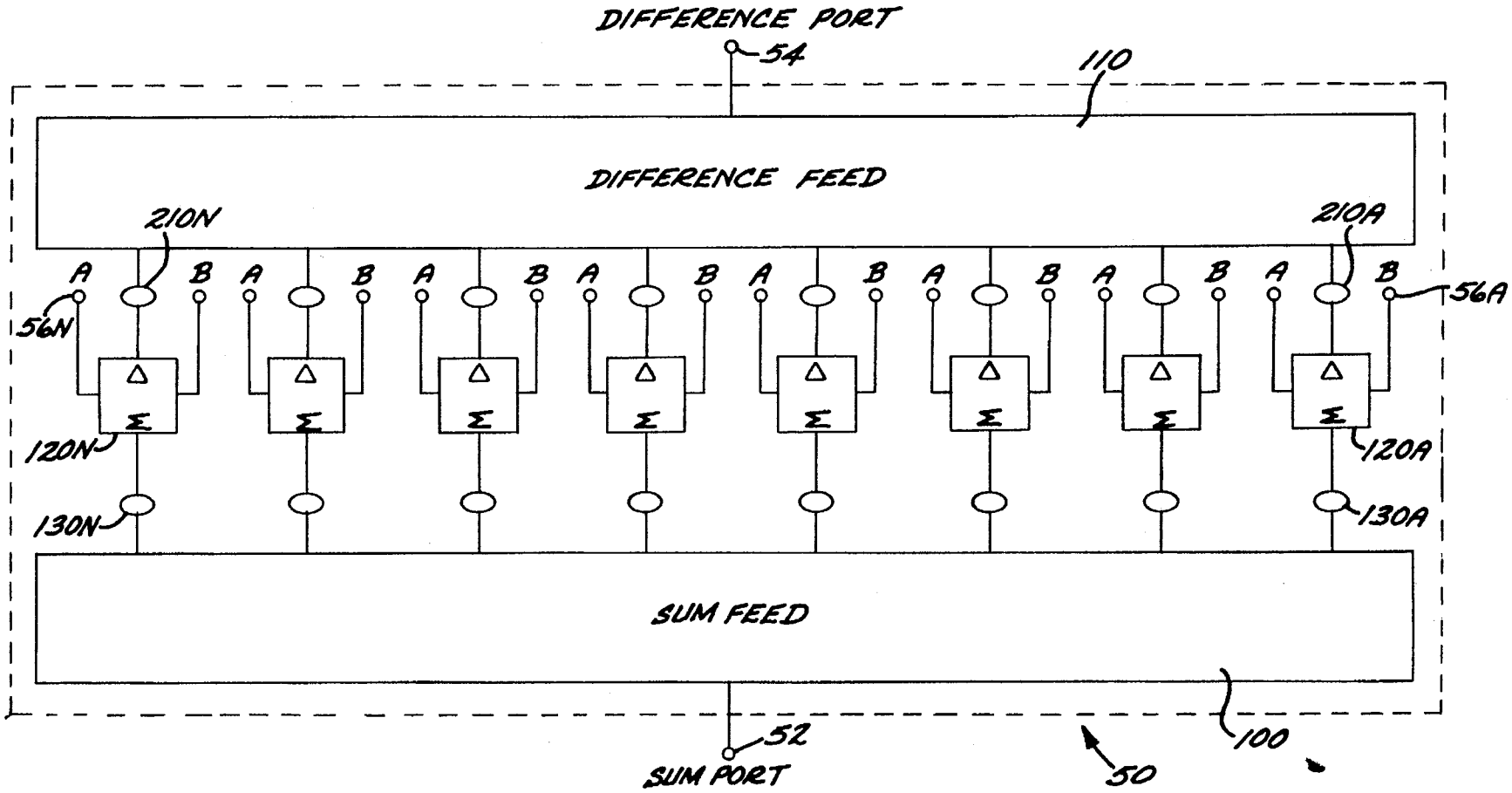
FIG. 4 is a schematic block diagram of a multiport monopulse network in accordance with this invention.

The network 50 comprises an arrangement of power dividers, phase shifters, attenuators and Magic-Tee couplers (or 180° hybrids). FIG. 4 illustrates a general schematic diagram of the network 50. The network includes a sum feed network 100, a difference feed network 110, the respective sum and difference ports 52 and 54, and output ports 56A–56N. A plurality of Magic-Tee couplers 120A–120N are connected between the output ports 56A–56N and interconnects 130A–130N at the output of the sum feed 100. This configuration can accommodate any number of ports and any type of amplitude distribution profile. The output ports labeled 'A' connect to one-half of the array while the output ports labeled 'B' are connected to the other half. The A and B output ports are connected to sidearms of the Magic-Tee couplers.

Figure 5A:
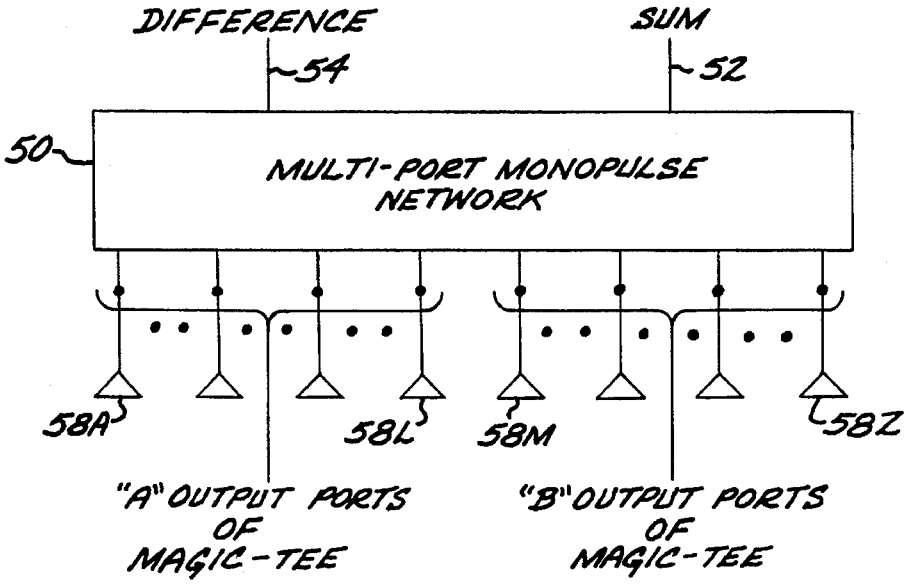
FIGS. 5A and 5B are schematic block diagrams illustrating multiport monopulse networks used for single plane and two-plane tracking, respectively.
Figure 5B:
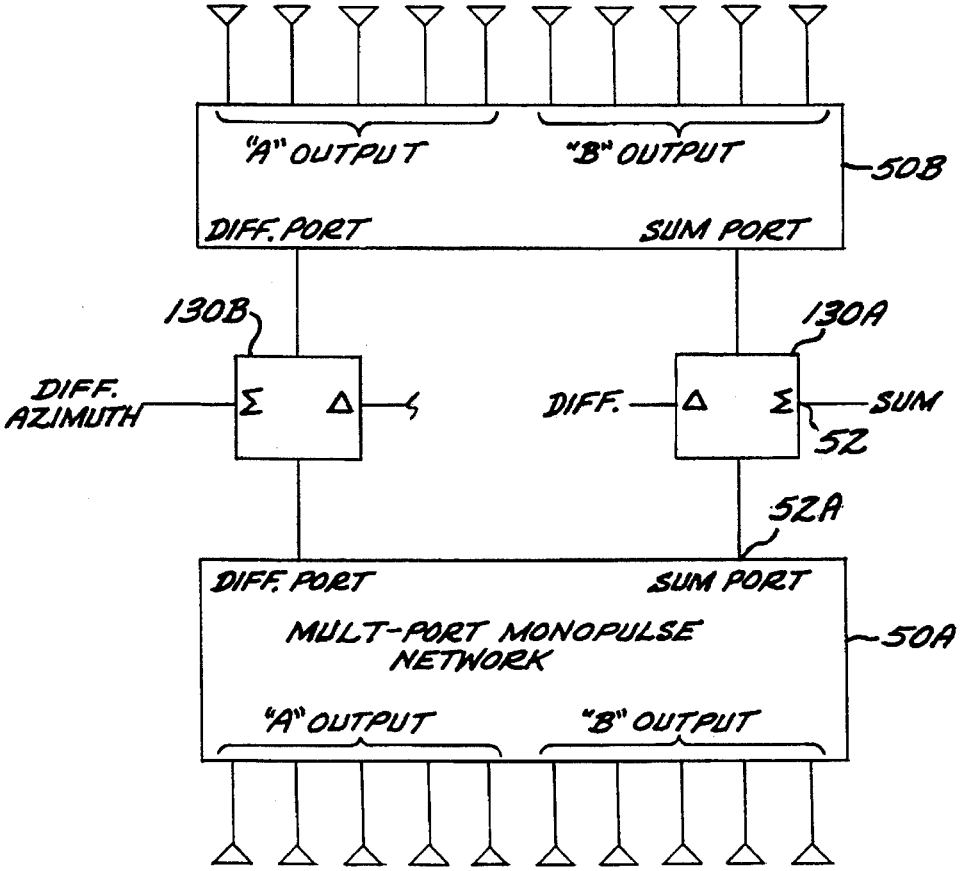

FIGS. 5A and 5B illustrate the manner in which a network in accordance with the invention is connected to the antenna array to perform single plane and two plane monopulse tracking, respectively, for radar applications. For single plane tracking, the "A" output ports of the network are connected to radiating elements 58A–58L on the left side of the array, and the "B" output ports are connected to radiating elements on the right side of the array. Single plane tracking is the use of the formed patterns/beams to develop angular discriminants of targets in a one dimensional plane, i.e., left to right versus up to down. In the arrangement of FIG. 5B, two monopulse networks 50A and 50B are employed for two plane monopulse tracking, with the sum ports 52A and 52B connected to sidearm ports of a Magic-Tee coupler 130A. The difference ports 54A and 54B are connected to the sidearm ports of another Magic-Tee coupler 130B. The sum port 52 to the composite network is the sum port of the coupler 130A. The composite network has azimuth and elevation difference ports, with the difference port of the coupler 130A serving as the composite network difference elevation port, and the difference port of the coupler 130B serving as the composite network difference azimuth port. For the arrangement of FIG. 5B, the radiating elements are divided into quadrants, and the respective "A" and "B" output ports of the networks 50A and 50B are connected to respective quadrants of the radiating elements.

Figure 6A:
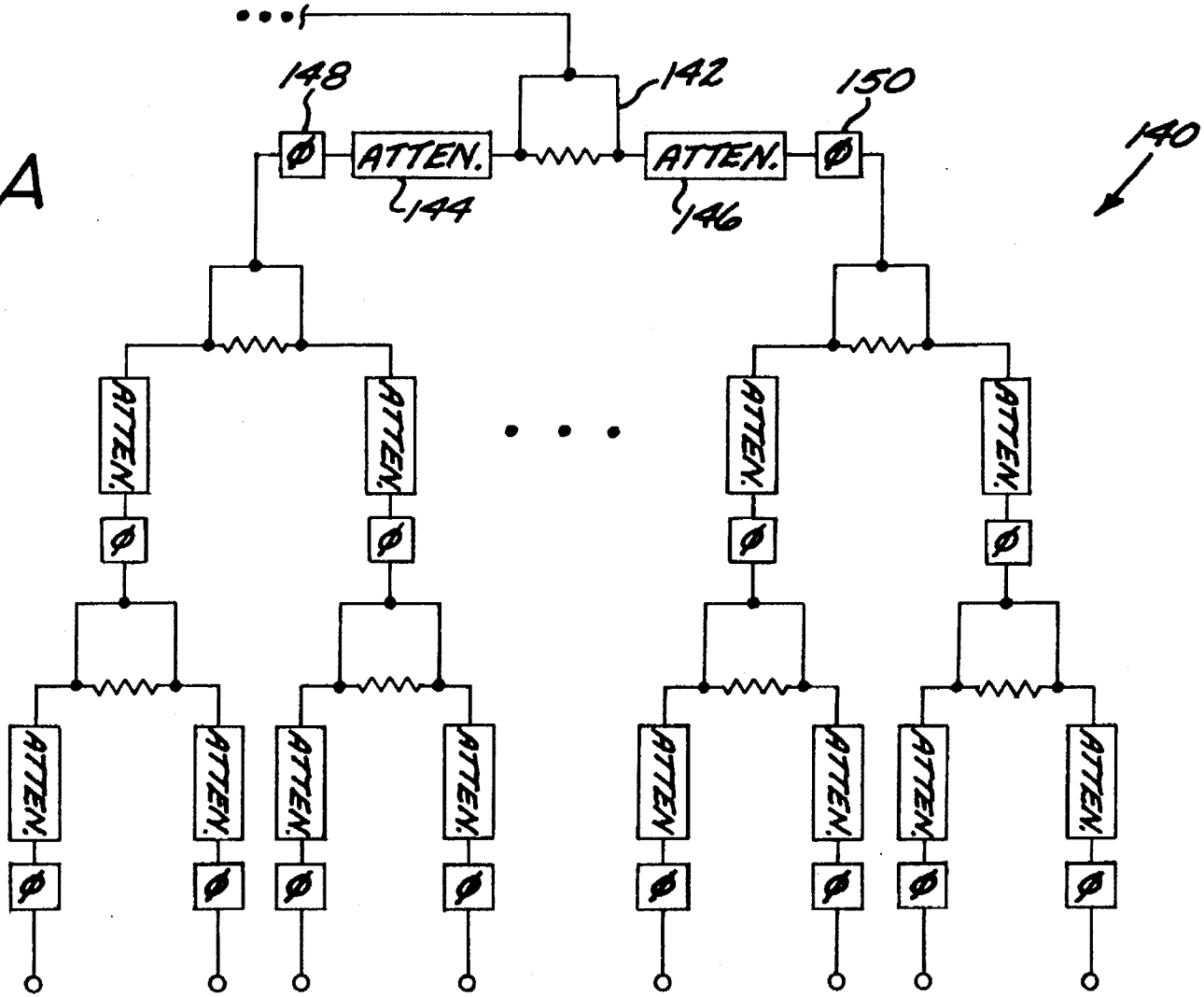
FIGS. 6A–6C are schematic diagrams of the circuit elements of the network of FIG. 4.

A general schematic of the internal feed circuit comprising a monopulse feed network 50 in accordance with the invention is shown in FIG. 6A. This general circuit is employed in both the sum feed 100 and the difference feed 110 of the network 50 as shown in schematic form in FIG. 4. In the general circuit 140 of FIG. 6A, a general signal divider/-combiner network is formed by a Wilkinson power divider 142, which divides an input signal into two channels. Each channel includes an attenuator and phase shifter. Thus, a first channel associated with power divider 142 includes attenuator 146 and 150, and a second channel includes attenuator 144 and 148. The circuit building block comprising elements 142, 144, 146, 148 and 150 is replicated to make up the general circuit 140.

Figure 6B:
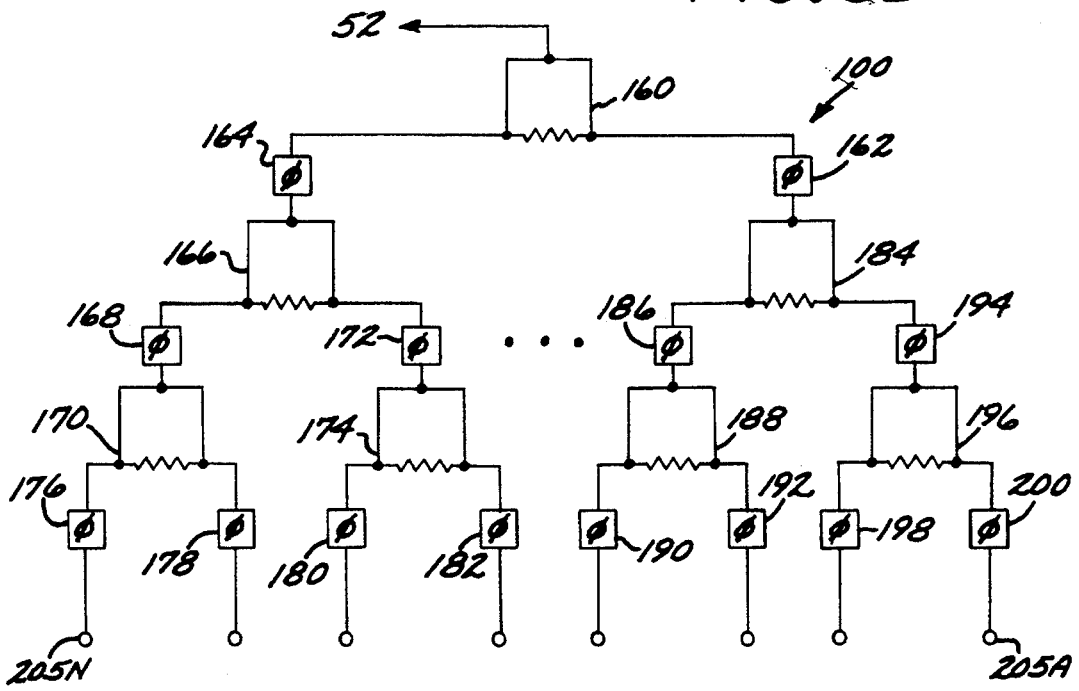

FIG. 6B shows the general sum feed circuit 100, which connects between the sum port 52 of the network and the interconnects 130A–130N. The sum circuit does not require the attenuators comprising the generalized circuit 140, i.e., the attenuation is zero. Thus, the sum port 52 is coupled to the power divider 160, which splits the signal power between the two outputs, connected to phase shifters 162 and 164, respectively. These two circuit legs are connected to further power dividers 166 and 184, which divide the power again between respective circuit legs, each having a phase shifter 168, 172, 186 and 194. The circuit is replicated again, with four power dividers 170, 174, 188, 196 coupled to these phase shifters to again divide the power between respective circuit legs. The outputs of the phase shifters 176, 178, 180, 182, 190, 192, 198 and 200 are connected to the I/O ports 205A–205N of the sum feed subassembly 100.

Figure 6C:
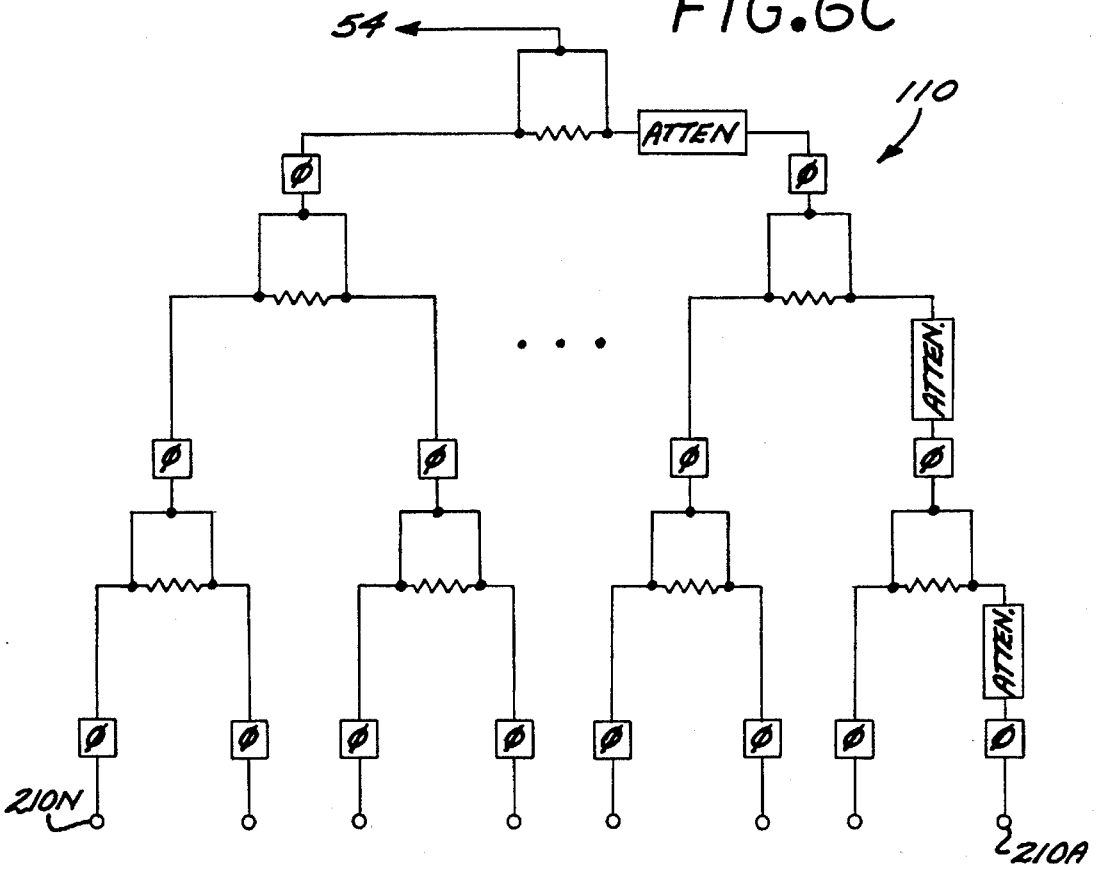

FIG. 6C illustrates a generalized difference feed circuit 110. This circuit is identical to the sum circuit 100, except that the attenuation in the right legs of certain of the divider circuits is non-zero. Any of the attenuators of the general circuit of FIG. 6A for the difference pattern can be non-zero, depending on the desired amplitude distribution.

The ports 205A–205N sum feed circuit 100 are connected to the sum (Σ) ports of the respective Magic-Tee couplers 120A–120N to generate an amplitude distribution across the monopulse network 50 output ports 56A–56N. The difference feed circuit 110 ports 210A–210N are connected to the difference (Δ) ports of the respective Magic-Tee couplers 120A–120N to generate a separate amplitude distribution across the same output ports 56A–56N.

The power dividers comprising the sum and difference circuits 100 and 110 generate the desired amplitude distributions for the sum and difference channels. Because of physical constraints, there are limitations in realizing certain levels of power splits across various bandwidths. Incorporating attenuators in the feed circuits 100 and 110 as needed helps to overcome these limitations. The separate sum and difference phase distributions can be generated by incorporating line lengths or fixed phase shifters as needed within the networks. The phase shifters can be incorporated within the feed circuits as shown in FIGS. 6B and 6C, or at the Magic-Tee coupler 120A–120N output ports.

The Magic-Tee couplers 120A–120N provide the 0°/180° phase difference across the two halves of the array and isolate the sum and difference channels. In the preferred embodiment, all of the components comprising the network 50 are integrated together into a single package assembly. Air-stripline type transmission lines are used to realize the phase shifters, power dividers and Magic-Tees. The use of air-stripline provides the lowest loss performance in the smallest integrated package. The channelized housings that support the stripline circuit boards can be either lightweight metal or plated plastic.

Figure 7:
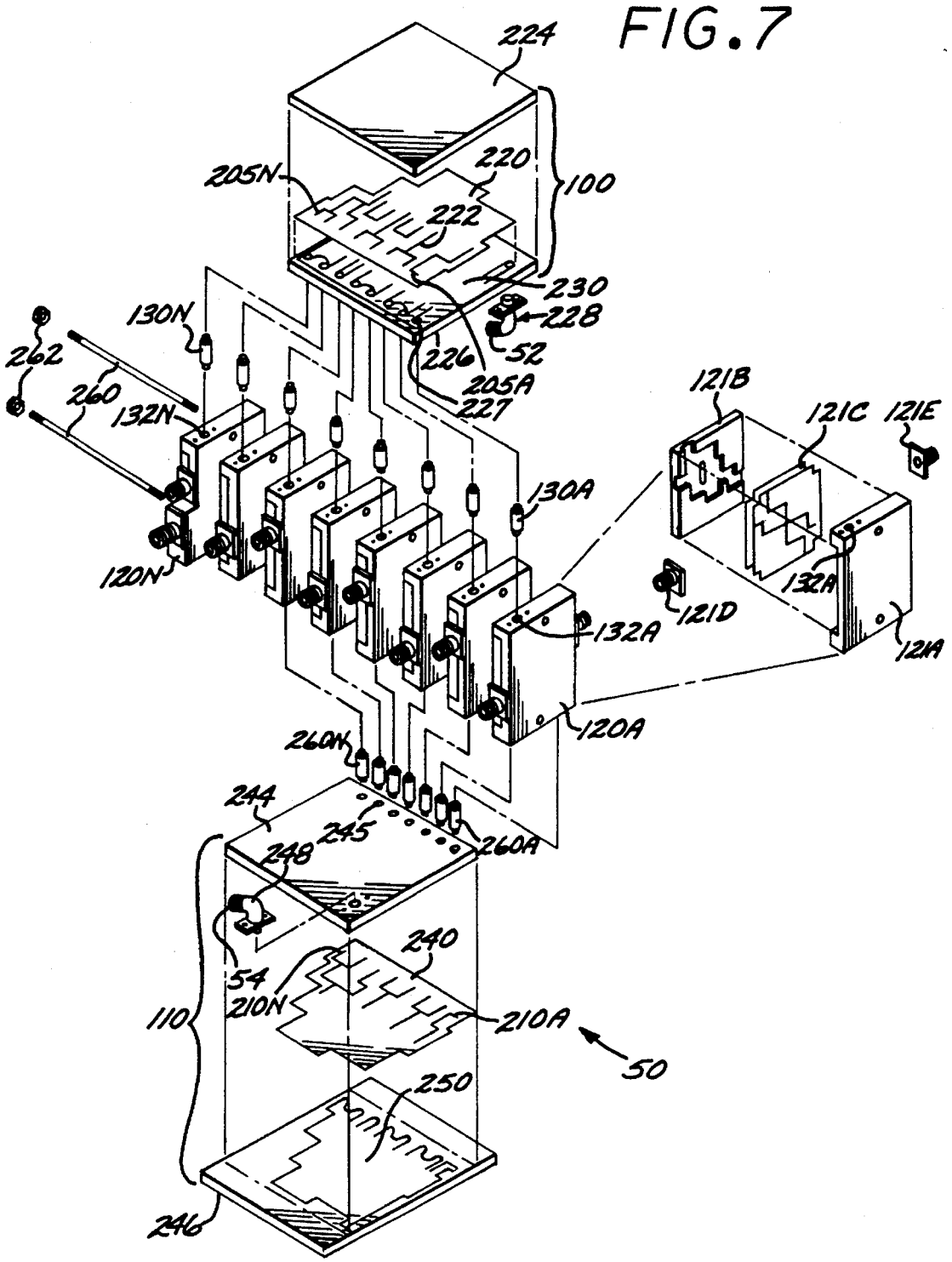
FIG. 7 is an exploded isometric view of an exemplary embodiment of the network of FIG. 4.

FIG. 7 is an exploded isometric view of a preferred embodiment of the monopulse multiport network 50. Here, the sum and difference feed circuit subassemblies 100 and 110 are shown in exploded form. The Magic-Tee couplers 120A–120N and interconnects 130A–130N are disposed between the subassemblies 100 and 110.

The sum feed subassembly 100 includes a stripline substrate board 220 carrying a conductive trace pattern 222, sandwiched between first and second machined aluminum housings 224 and 226. Each housing is machined to define channel patterns, e.g., pattern 230 defined on housing 226, which are mirror images of the other, and which serve as ground planes for the air stripline transmission line comprising the substrate 220 and the trace pattern 222. A coaxial connector 228 is connected to a port of the stripline transmission line, and provides the sum I/O port 52 for the network 50.

The difference feed subassembly 110 is similar to the sum feed subassembly 100, and comprises a suspended air stripline transmission line defined by a substrate board 240 carrying a conductive trace pattern 242, sandwiched between respective housings 244 and 246. Each housing is machined to define a channel pattern, e.g., pattern 250. A coaxial connector 248 is connected to a port of the suspended stripline, and serves as the difference I/O port 54 of the network 50.

Orthogonal coaxial feedthrough interconnects 260A–260N are employed to connect the suspended stripline transmission line circuit outputs 210A–210N of the difference circuit 110 and the Magic-Tee coupler 120A–120N difference ports. In this embodiment, the Magic-Tee difference port is implemented in suspended stripline as well. The coaxial interconnects 260A–260N comprise a center pin conductor with a dielectric plug, extending through bores 245 defined in housing 244, to allow the center pin to be connected to the conductive trace 242. The pin and plug also extends through a corresponding bore (not shown) in the housing of the corresponding Magic-Tee coupler to connect to circuitry comprising the coupler. In a similar fashion, orthogonal coaxial feedthrough interconnects 130A–130N are employed to connect the suspended stripline circuit outputs 205A–205N of the sum circuit 100 and the sum ports of the Magic-Tee couplers 120A–120N. The interconnects 130A–130N comprise a center pin conductor with a dielectric plug, extending through bores 227 defined in housing 226, to allow the center pins to be connected to the conductive trace 222. The interconnect pins and plugs extend through corresponding bores 132A–132N formed in the housing comprising the couplers 120A–120N to connect to circuitry comprising the couplers.

The Magic-Tee couplers 120A–120N are secured in an aligned relationship by tension bolts 260 and fasteners 262. The Magic-Tee couplers are described in commonly assigned U.S. Pat. No. 4,952,895, the entire contents of which are incorporated herein by this reference. Double sided air-stripline and stripline are combined to fabricate the Magic-Tee couplers. Exemplary coupler 120A is shown in exploded form in FIG. 7, and includes channelized conductive housings 121A and 121B, and double-sided stripline circuit 121C. Coaxial connectors 121D and 121E are connected to the stripline circuit 121C, and form a means of connection of the sidearm ports of the coupler 120A to the array elements or partitioned feeds.

Figure 8A:
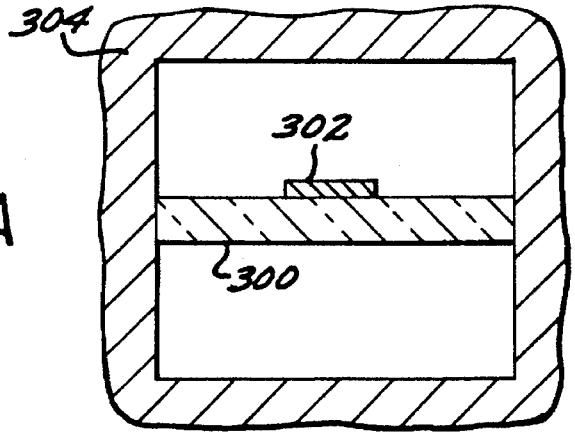
FIGS. 8A–8C illustrate three types of suspended air-stripline employed in the network of FIG. 7.
Figure 8B:
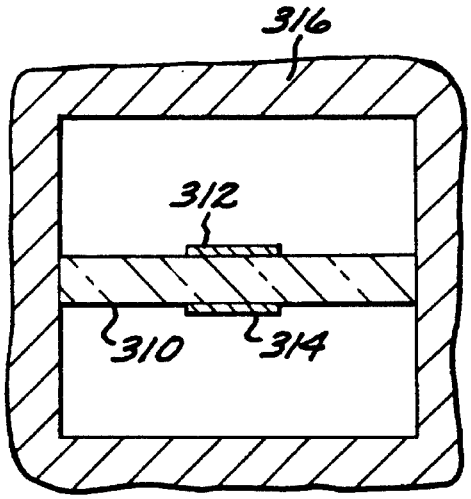
Figure 8C:
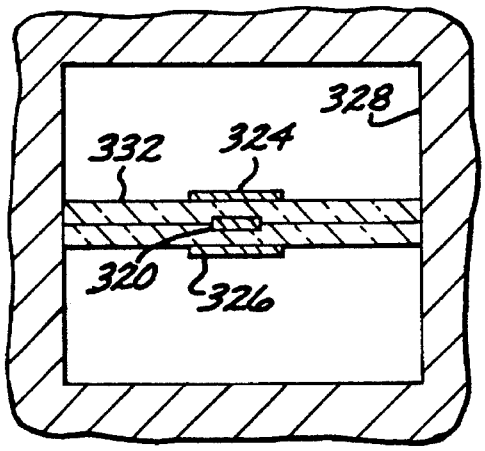

FIGS. 8A–8C show the various air-stripline configurations used in the network. Suspended substrate stripline transmission lines are used to realize the Wilkinson power dividers and phase shifters. All component ports are designed to have 50 ohms impedance. The configuration of FIG. 8A is a channelized suspended substrate stripline, where the dielectric substrate 300 carries a stripline conductor 302, and is suspended within an enclosed metal channel 304. FIG. 8B shows a double-sided air stripline circuit, comprising a dielectric substrate 310 with first and second opposed metal conductors 312 and 314 formed on opposing sides of the dielectric 310, which is suspended within metal channel 316. FIG. 8C shows a stripline center conductor 320 embedded within a suspended dielectric substrate 322 formed by two adjacent substrate boards, with first and second opposed outer conductors 324 and 326 formed on opposing sides of the substrate 322. The substrate 322 is suspended within metal channel 328.

To minimize the package size, multiple circuit boards, housings and non-planar orthogonal interconnects are used. The interconnects use coaxial feedthroughs such that the ends of center pins are soldered to the center traces of the air-stripline boards (FIGS. 9A–9C and FIGS. 10A–10C). Pilot holes are drilled at the locations where the air-stripline/stripline ports of the different boards are to connect. The pilot holes will act as the outer conductor of the coax feedthrough upon assembly of the entire unit. The dielectric plugs surrounding the center pins are used to align the pins to the proper soldering locations of the circuit boards. The dielectric plugs also serve as guide pins to align the housing sub-assemblies together as an integral unit. Further improvement for multi-interconnects can be made by providing self-aligning features such as opening up the pilot holes to allow greater tolerance for assembly, as described in commonly assigned U.S. Pat. No. 4,957,456, the entire contents of which are incorporated herein by this reference. All dimensions of these feedthroughs are designed to realize 50 ohm impedance throughout and are stepped (as needed) to minimize junction effects and to provide impedance match between boards on different orientations and transmission lines.

FIG. 9A shows a cross-section of an exemplary sum feed circuit 100 output port 205A, with the substrate board 220 sandwiched between conductive housings 224 and 226. The transmission line here is a suspended substrate stripline circuit. The bore 227 is shown formed in housing 226. FIG. 9B shows a cross-section of the Magic-Tee coupler 120A, with the interconnect 130A in place. The bore 132A formed in the coupler housing forms a coaxial outer conductor and pilot hole for the feedthrough. The interconnect includes a center conductor pin 133A and a dielectric plug 133B which fits into the hole 132A. The pin 133A is stepped, and has a slotted end 133D. An epoxy captive 133C extends about the pin at the stepped area. The slotted end of the pin 133D is soldered to the conductive traces formed on each side of the double-sided stripline circuit 121C, which also includes an embedded stripline conductor (not shown in FIG. 9B). FIG. 9C shows the same sum feed output port as FIG. 9A, but in assembly with the Magic-Tee coupler 120A and interconnect 130A as shown in FIG. 9B. The pin 133A fits through a bore formed in the substrate 220, and is soldered to the conductive trace 222 defined on the upper surface of the substrate 220.

FIGS. 10A–10C illustrate in more detail the interconnection between the difference feed circuit assembly 110 and the respective Magic-Tee couplers 120A–120N. FIG. 10A shows exemplary difference feed output port 210A, at the difference feed suspended substrate stripline circuit 240. The circuit 240 is suspended between the housings 244 and 246. Hole 245 formed in housing 244 serves as the coaxial outer conductor and pilot hole for the interconnect feedthrough 260A. FIG. 10B shows the Magic-Tee coupler 120A in cross-section, with the coaxial interconnect 260A in position. The center conductor 261A of the coaxial interconnect 260A is stepped in diameter down to make contact at a tab end of the pin with the embedded stripline conductor 121D at the Magic-Tee difference port 121F. The interconnect further includes a dielectric plug 261B which fits into bore 245 formed in the housings 121A and 121B, and epoxy captive 261C. FIG. 10C shows the difference feed 110 and coupler 120A in assembled form. The top of the pin 261A fits through a bore formed in the substrate 240, and is soldered to the conductive trace 242 at the difference feed output port 210A.

The integration of the network 50 is somewhat analogous to the integration techniques used in PWB assemblies, where a number of PWB daughter boards are integrated to two PWB backplane mother boards. The invention can operate across an octave band. At the same time, size and weight of the network 50 can still be made comparable to conventional networks.

It is understood that the above-described embodiments are merely illustrative of the possible specific embodiments which may represent principles of the present invention. Other arrangements may readily be devised in accordance with these principles by those skilled in the art without departing from the scope and spirit of the invention.

What is claimed is:

1. A monopulse radar array system, comprising:

a plurality of radiating elements; and a multi-port monopulse feed network coupled to said plurality of radiating elements, said monopulse feed network comprising:

a sum feed network assembly having a sum input/output (I/O) port connected to a plurality of sum output ports by a sum feed circuit, said sum feed network assembly for producing a first amplitude distribution of signals at said sum output ports in response to a signal exciting said sum I/O port;

a difference feed network having a difference I/O port connected to a plurality of difference output ports by a difference feed circuit, said difference feed network assembly for producing a second amplitude distribution of signals at said difference output ports in response to a signal exciting said difference I/O port;

wherein said first and second amplitude distributions are respective separate and independent distributions;

a plurality of power divider/combiner coupler devices, each said coupler device having a coupler sum port, a coupler difference port, and first and second sidearm ports;

interconnection means for interconnecting said plurality of sum output ports of said sum feed network assembly to a corresponding coupler sum port, and for interconnecting said plurality of difference output ports of said difference feed network assembly to a corresponding coupler difference port;

first means for coupling said first coupler sidearm ports to a first set of said radiating elements; and second means for coupling said second coupler sidearm ports to a second set of said radiating elements;

wherein said monopulse feed network provides separate and independent sum and difference amplitude distributions of signals across said radiating elements.

2. The array system of claim 1 wherein said coupler devices comprise Magic-T coupler devices.

3. The array system of claim 1 wherein said coupler devices comprise 180 degree hybrid coupler devices.

4. The array system of claim 1 wherein said sum feed circuit is fabricated with air-stripline transmission lines.

5. The array system of claim 1 wherein said sum feed circuit comprises a plurality of power divider circuits selected to achieve a desired sum amplitude distribution across said sum circuit output ports.

6. The array system of claim 5 wherein said sum feed circuit further comprises a plurality of phase shifter devices.

7. The array system of claim 1 wherein said difference feed circuit comprises a plurality of power divider circuits and a plurality of attenuator devices to achieve a desired difference amplitude distribution across said difference circuit output ports.

8. The array system of claim 7 wherein said sum feed circuit further comprises a plurality of phase shifter devices.

9. The array system of claim 1 wherein said difference feed circuit is fabricated with an air-stripline transmission line.

10. The array system of claim 1 wherein said sum feed network assembly comprises a sum planar air-stripline circuit disposed in a first plane, said difference feed network assembly comprises a difference planar air-stripline circuit disposed in a second plane parallel to said first plane, said plurality of coupler devices disposed between said sum feed network assembly and said difference feed network assembly.

11. The array system of claim 10 wherein said interconnection means comprises a first set of orthogonal coaxial feedthrough interconnection means for interconnecting said plurality of sum output ports to said corresponding coupler sum ports, said first set comprising a first plurality of coaxial center conductor pins connected orthogonal to said first plane between said sum planar air-stripline circuit and said sum ports of said couplers.

12. The array system of claim 10 wherein said interconnection means comprises a second set of orthogonal coaxial feedthrough interconnection means for interconnecting said plurality of difference output ports to said corresponding coupler difference ports, said second set comprising a second plurality of coaxial center conductor pins connected orthogonal to said second plane between said difference planar air-stripline circuit and said difference ports of said couplers.

13. The array system of claim 1 wherein said first means for coupling said first coupler sidearm ports comprises a first partition feed network connected between one or more of said first sidearm ports and a first cluster of radiating elements, and wherein said second means for coupling said second coupler sidearm ports comprises a second partition feed network connected between one or more of said second sidearm ports and a second cluster of radiating elements.

14. The array system of claim 1 wherein said power divider/combiner coupler devices electrically isolate said sum feed network assembly from said difference feed network.

15. The array system of claim 11 wherein said interconnection means comprises a second set of orthogonal coaxial feedthrough interconnection means for interconnecting said plurality of difference output ports to said corresponding coupler difference ports, said second set comprising a second plurality of coaxial center conductor pins connected orthogonally to said second plane between said difference planar air-stripline circuit and said difference ports of said couplers, and wherein said sum feed network assembly, said difference feed network, said plurality of power divider/combiner coupler devices and said interconnection means are integrated together to form an integrated assembly.

16. The array system of claim 11 wherein said sum planar air-stripline circuit is a single-sided air-stripline circuit, and said coupler devices comprise Magic-T coupler devices having a sum port circuit fabricated on a double-sided air-stripline circuit.

17. The array system of claim 12 wherein said difference planar air-stripline circuit is a single-sided air-stripline circuit, and said coupler devices comprise Magic-T coupler devices having a difference port circuit fabricated on a stripline circuit.

* * * * *

UNITED STATES PATENT AND TRADEMARK OFFICE

CERTIFICATE OF CORRECTION

PATENT NO. : 5,506,589

DATED : April 9, 1996

INVENTOR(S) : Clifton Quan et al.

It is certified that error appears in the above-identified patent and that said Letters Patent is hereby corrected as shown below:

Column 1, line 4, before the heading "BACKGROUND OF THE INVENTION," insert the paragraph: --This invention was made with Government support under Contract funds awarded by the Government. The Government has certain rights in this invention.--

Signed and Sealed this

Eighth Day of October, 1996

*Attest:*

Bruce Lehman

BRUCE LEHMAN

*Attesting Officer*

*Commissioner of Patents and Trademarks*